United States Patent [19]

Schlie et al.

[11] Patent Number: 5,008,593

[45] Date of Patent: Apr. 16, 1991

[54] COAXIAL LIQUID COOLING OF HIGH POWER MICROWAVE EXCITED PLASMA UV LAMPS

[75] Inventors: LaVerne A. Schlie; Robert D. Rathge, both of Albuquerque, N. Mex.

[73] Assignee: The United States of America as represented by the Secretary of the Air Force, Washington, D.C.

[21] Appl. No.: 553,929

[22] Filed: Jul. 13, 1990

[51] Int. Cl.[5] ..... H01J 7/46

[52] U.S. Cl. ..... 315/39; 313/22; 313/36

[58] Field of Search ..... 372/35; 313/22, 36; 315/39

[56] References Cited

U.S. PATENT DOCUMENTS

| | | | |
|---|---|---|---|
| 3,401,302 | 9/1968 | Thorpe et al. | 313/22 |
| 3,641,389 | 2/1972 | Leidigh | 313/36 |
| 3,876,901 | 4/1975 | James | 313/36 |
| 3,885,984 | 5/1975 | Wright | 106/287 |
| 4,045,119 | 8/1977 | Eastgate | 350/96 |
| 4,500,996 | 2/1985 | Sasnett et al. | 372/19 |
| 4,617,667 | 10/1986 | Penn | 372/35 |
| 4,715,039 | 12/1987 | Miller et al. | 372/37 |
| 4,737,678 | 4/1988 | Hasegawa | 313/36 |
| 4,868,450 | 9/1989 | Colterjohn, Jr. | 313/36 |
| 4,933,650 | 6/1990 | Okamoto | 315/39 |

*Primary Examiner*—James W. Davie

*Attorney, Agent, or Firm*—Bobby D. Scearce; Donald J. Singer

[57] ABSTRACT

In a high power microwave excited plasma system including a microwave energy source operatively coupled to a plasma tube for generating a plasma within the tube, a gaseous medium within the tube for supporting a plasma and a reflector for focusing radiation emitted from the tube, an improved cooling system for the tube is provided which comprises a jacket surrounding the tube and defining a passageway therearound, a source of liquid dimethyl polysiloxane, and a circulator for conducting the liquid dimethyl polysiloxane through the passageway in heat exchange relationship with the tube.

5 Claims, 1 Drawing Sheet

COAXIAL LIQUID COOLING OF HIGH POWER MICROWAVE EXCITED PLASMA UV LAMPS

RIGHTS OF THE GOVERNMENT

The invention described herein may be manufactured and used by or for the government of the U.S. for all governmental purposes without the payment of any royalty.

CROSS REFERENCE TO RELATED APPLICATION

The invention described herein is related to copending application Ser. No. 07/553,928 filed Jul. 13, 1990, entitled LIQUID COOLANT FOR HIGH POWER MICROWAVE EXCITED PLASMA TUBES.

BACKGROUND OF THE INVENTION

The present invention relates generally to systems for generating microwave excited plasma discharges, and more particularly to systems for effectively cooling high power microwave plasma tubes.

In the copending application, use of liquid dimethyl polysiloxane as a coolant of high power, microwave (2450 MHz) excited plasmas useful as high intensity ultraviolet (UV), visible and infrared (IR) lamps was demonstrated. Liquid dimethyl polysiloxane used in coolant system structures of suitable configuration exhibited high UV and visible transmission, low microwave absorption at the desired microwave operating frequency, ability to withstand high cw or pulsed UV and visible fluences, non-toxicity and non-flammability, large IR absorption and desirable physical chemistry properties (low viscosity, low vapor pressure, large heat capacity, high thermal conductivity). The teachings of the copending application and background material presented therein are incorporated herein by reference.

Existing UV lamp systems that incorporate microwave excited plasmas mounted in a reflector assembly generally require large air cooling capacity (e.g., 240 cfm) and a.c. (60 Hz) power to the magnetrons. The present invention solves this deficiency in prior art structures by providing a coolant system in a reflector assembly for a microwave excited plasma incorporating liquid dimethyl polysiloxane as coolant. The cooling system provided by the invention obviates the need for large gas flow cooling capability for the plasma tube, can accommodate any reflector geometry (e.g. elliptical, circular, spherical, parabolic or involute), and allows higher (viz., about two times) power loadings to be accomplished for the plasmas.

It is therefore a principal object of the invention to provide a coolant system for high power microwave excited UV lamps utilizing liquid dimethyl polysiloxane in a reflector assembly capable of focusing output radiation.

It is another object of the invention to provide transverse or coaxial liquid cooling to a microwave excited plasma tube in a UV, visible or IR reflector assembly of any geometry.

These and other objects of the invention will become apparent as a detailed description of representative embodiments proceeds.

SUMMARY OF THE INVENTION

In accordance with the foregoing principles and objects of the invention, in a high power microwave excited plasma system including a microwave energy source operatively coupled to a plasma tube for generating a plasma within the tube, a gaseous medium within the tube for supporting a plasma and a reflector for focusing radiation emitted from the tube, an improved cooling system for the tube is provided which comprises a jacket surrounding the tube and defining a passageway therearound, a source of liquid dimethyl polysiloxane, and a circulator for conducting the liquid dimethyl polysiloxane through the passageway in heat exchange relationship with the tube.

DESCRIPTION OF THE DRAWINGS

The invention will be more clearly understood from the following detailed description of representative embodiments thereof read in conjunction with the accompanying drawings wherein.

DETAILED DESCRIPTION

Figure 1:
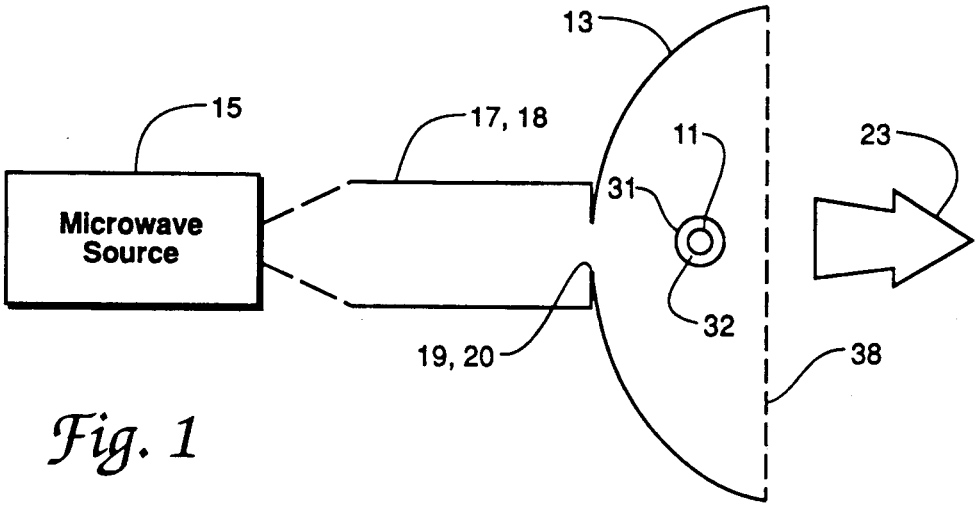
FIG. 1 is a schematic sectional view of a microwave excited plasma tube mounted inside an elliptical reflector.
Figure 2:
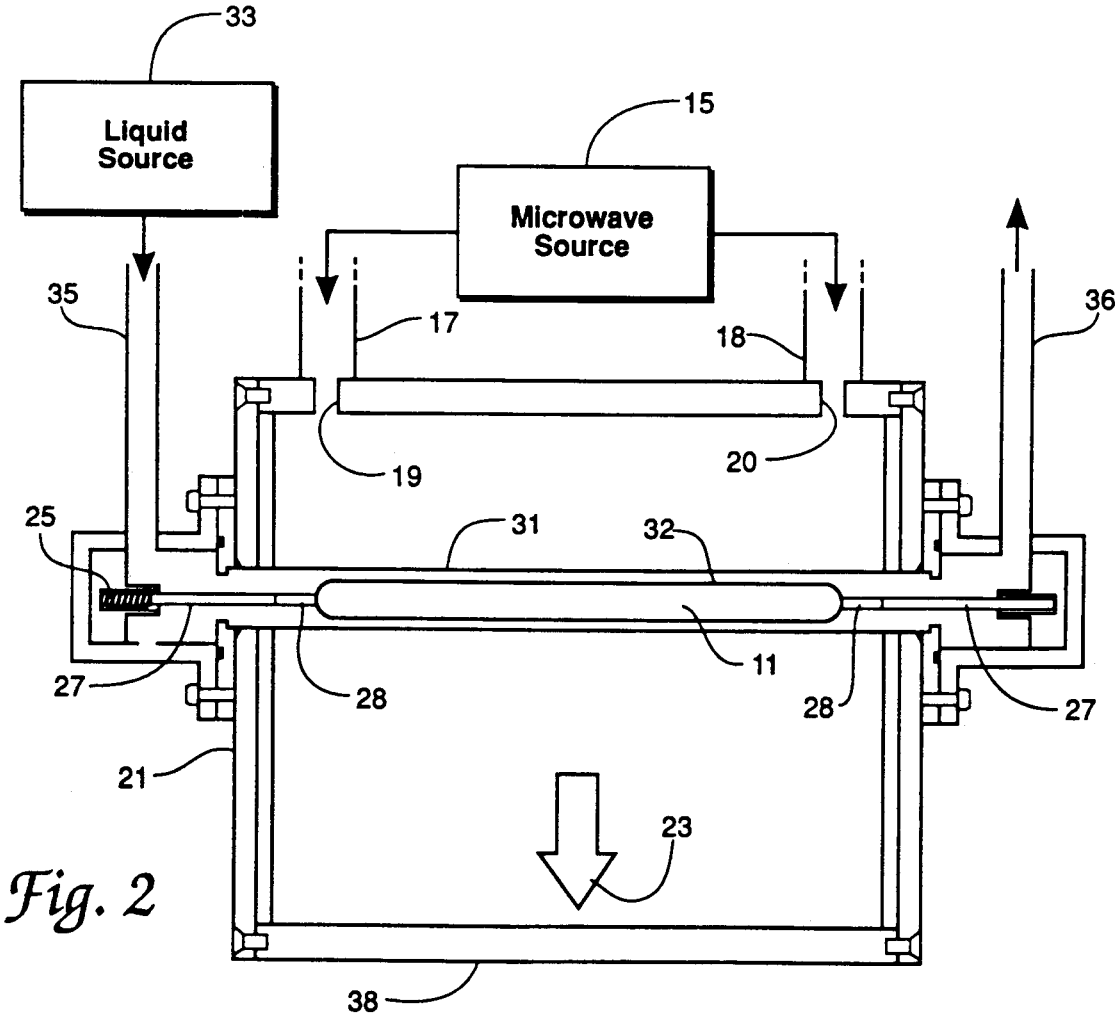
FIG. 2 is a schematic sectional view of the FIG. 1 plasma tube coupled to a microwave source and cooled according to the invention.

Referring now to FIGS. 1 and 2, shown therein are schematic sectional views of a microwave excited plasma tube 11 mounted inside an elliptical reflector 13. Plasma tube 11 may comprise an electrodeless quartz lamp coupled to a microwave source 15 and cooled according to the teachings of the invention. Microwave source 15 (usually about 2450 MHz) provides continuous or pulsed excitation to plasma tube 11, and is operatively coupled into plasma tube 11 by way of waveguides 17, 18 and slotted couplers 19, 20 defined in reflector 13 between waveguides 17, 18 and housing 21 for containing plasma tube 11. Tube 11 is mounted inside elliptical reflector 13 at the focus of an ellipsoid defined by reflector 13, and is filled with suitable gaseous plasma medium such as xenon, mercury, argon, halides (gaseous or solid), boron chloride or mercury vapor/gas mixtures at pressures of about $10^{-3}$ to 10 atm. Tube 11 may be of any suitable length, viz., about 2 to 100 cm, and inner diameter, viz., about 0.01 to 10 cm, limited only by the power of microwave source 15, a tube operated in demonstration of the invention being about 25 cm in length and 1 cm ID. Reflector 13 comprises suitable metallic reflective material such as aluminum, copper, gold or multi-stack dielectrics, and functions to selectively focus ultraviolet (UV), visible or infrared (IR) radiation 23 emitted from plasma tube 11. It is noted that other geometrical configurations for reflector 13 may be used in contemplation of the invention, such as parabolic, involute or spherical shapes, the same not considered limiting of the invention. Plasma tube 11 may be resiliently mounted at spring 25 in a non-compressive manner within housing 21 between aluminum posts 27 and quartz canes 28. Quartz cooling jacket 31 surrounds tube 11 and defines passageway 32 for the flow of liquid dimethyl polysiloxane coolant from source 33. Aluminum tubes connected to respective ends of jacket 31 define inlet 35 and outlet 36 for conducting coolant along passageway 32 in heat exchange relationship with tube 11. Jacket 31 is normally a few millimeters larger in diameter than tube 11 allowing a radial thickness for passageway 32 of at least 1-2 mm. Components of the demonstration system for containing and conducting the liquid dimethyl siloxane comprised aluminum in accordance with teachings of the cross reference. The liquid dimethyl polysiloxane was circulated utilizing a Neslab HX750 cooler and was kept in the temperature range of 20°-50° C. Liquid dimethyl polysiloxane has a very low microwave absorption value (tan $\delta=\epsilon''/\epsilon'=3.5\times10^{-4}$ or $\epsilon''=5.43\times10^{-4}$), absorbs negligible microwave energy ($\leqq$0.2 watts per cm per KW incident power) and is transparent to UV. As suggested in the cross reference, dimethyl polysiloxane remains a clear liquid from −73° to 260° C. Tube 11 and jacket 31 comprises quartz or other material transparent to UV such as sapphire, beryllium oxide, magnesium fluoride or lithium fluoride. An rf screen/UV window 38 (optional) may be disposed across reflector 13 to prevent leakage of microwave radiation and simultaneously to transmit the UV and visible output radiation 23 of tube 11.

The structure of FIGS. 1, 2 defines a coaxial configuration for cooling tube 11 according to the invention. However, it is noted that alternative structure incorporating transverse coolant flow could be assembled by one skilled in the art guided by these teachings, the transverse cooling configuration considered to be within the scope hereof.

The coolant system provided by the invention exhibits low microwave absorption (<0.2 watts per cm absorbed per KW incident microwave power at 2450 Mhz) which allows much higher volumetric power loadings ($\approx$300 watts/cm$^3$ or 5.4 KW in a volume of 20 cm$^3$), than is attainable in conventional systems, and eliminates noise and mechanical vibrations produced by the high gas flow required to cool a conventional plasma tube. Tube performance varied somewhat with the temperature of the coolant. The coolant is substantially transparent to the intense UV radiation from the plasma tube, absorbs a significant portion of the radiated heat (IR radiation, $\lambda>1.0$ micron) from the plasma tube and exhibits low microwave absorption.

The invention therefore provides a coolant system for high power microwave excited plasma lamps utilizing liquid dimethyl polysiloxane in a reflector assembly capable of focusing output radiation. It is understood that modifications to the invention may be made as might occur to one with skill in the field of the invention within the scope of the appended claims. All embodiments contemplated hereunder which achieve the objects of the invention have therefore not been shown in complete detail. Other embodiments may be developed without departing from the spirit of the invention or from the scope of the appended claims.

We claim:

1. In a high power microwave excited plasma system comprising:

(a) a source of microwave energy;

(b) a plasma tube operatively coupled to said source of microwave energy for generation of a plasma within said plasma tube in response to energy input thereinto from said source of microwave energy;

(c) a gaseous medium within said plasma tube for supporting a plasma therein;

(d) reflector means for focusing radiation emitted from said plasma tube; and (e) means for cooling said plasma tube;

an improvement wherein said means for cooling said plasma tube comprises, (f) a jacket surrounding said plasma tube and defining a passageway around said plasma tube within said jacket;

(g) a source of liquid dimethyl polysiloxane; and (h) means for circulating said liquid dimethyl polysiloxane through said passageway in heat exchange relationship with said plasma tube for cooling said plasma tube.

2. The system of claim 1 wherein said liquid dimethyl polysiloxane has temperature in the range of −73° to 260° C.

3. The system of claim 1 wherein said reflector means has a geometric shape selected from the group consisting of elliptical, parabolic, involute and spherical.

4. The system of claim 1 wherein said gaseous medium comprises a material selected from the group consisting of xenon, mercury, a halide and boron chloride.

5. The system of claim 4 wherein said gaseous medium has pressure of from $10^{-3}$ to 10 atm.

* * * * *